United States Patent [19]

Southard

[11] 4,348,992

[45] Sep. 14, 1982

[54] ENGINE BLOCK HEATER

[76] Inventor: Edward S. Southard, 1101 W. Pine St., Lodi, Calif. 95240

[21] Appl. No.: 110,692

[22] Filed: Jan. 9, 1980

[51] Int. Cl.[3] ..... F02M 17/02

[52] U.S. Cl. ..... 123/142.5 R; 122/120

[58] Field of Search ..... 123/142.5 R, 142.5 E; 126/350 A; 122/120 B

[56] References Cited

U.S. PATENT DOCUMENTS

| | | | |
|---|---|---|---|
| 1,107,534 | 8/1914 | Lovekin | 122/20 B |
| 1,948,735 | 2/1934 | Russo | 122/20 B |
| 2,681,052 | 6/1954 | Kazial | 123/142.5 B |
| 2,695,602 | 11/1954 | Willians | 123/142.5 R |
| 3,131,864 | 5/1964 | Young | 123/142.5 R |
| 3,400,700 | 9/1968 | Lindsey | 126/350 A |
| 3,501,257 | 3/1970 | Hilton | 126/350 A |

*Primary Examiner*—Ronald H. Lazarus

*Attorney, Agent, or Firm*—Blair, Brown & Kreten

[57] ABSTRACT

A heater for heating the coolant in a liquid-cooled internal combustion engine including concentrically arranged inner and outer casings defining a water chamber which communicates with the water in the engine block together with a coil in the interior of the inner casing having one end communicating with the water chamber and one end with the engine block so that fluid in the coil heated by hot gases from a propane gas burner provides circulation of heated water through the water chamber and engine block maintaining the block in a heated condition for easy starting.

10 Claims, 4 Drawing Figures

FIG. 1
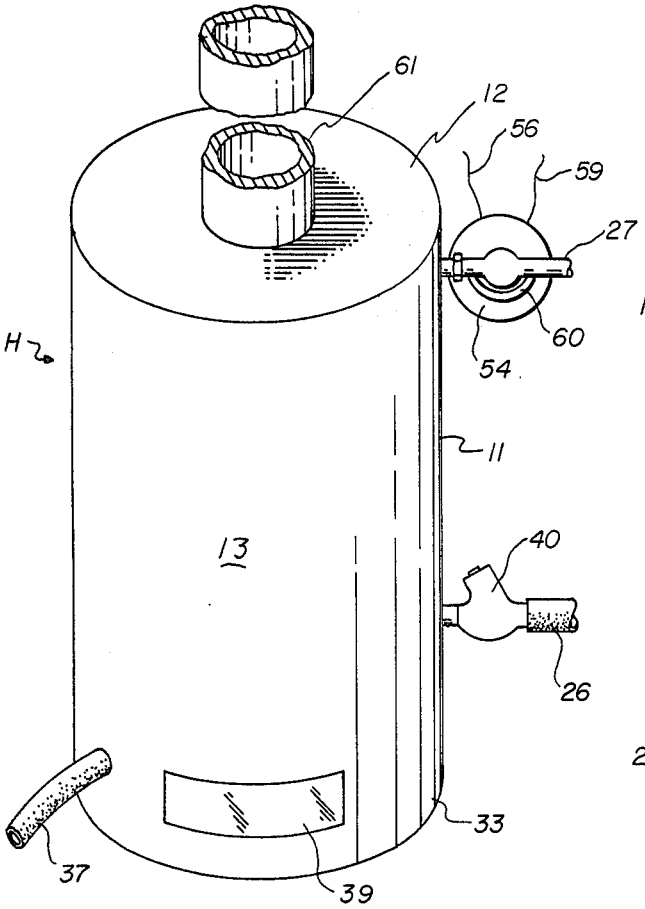
FIG. 2
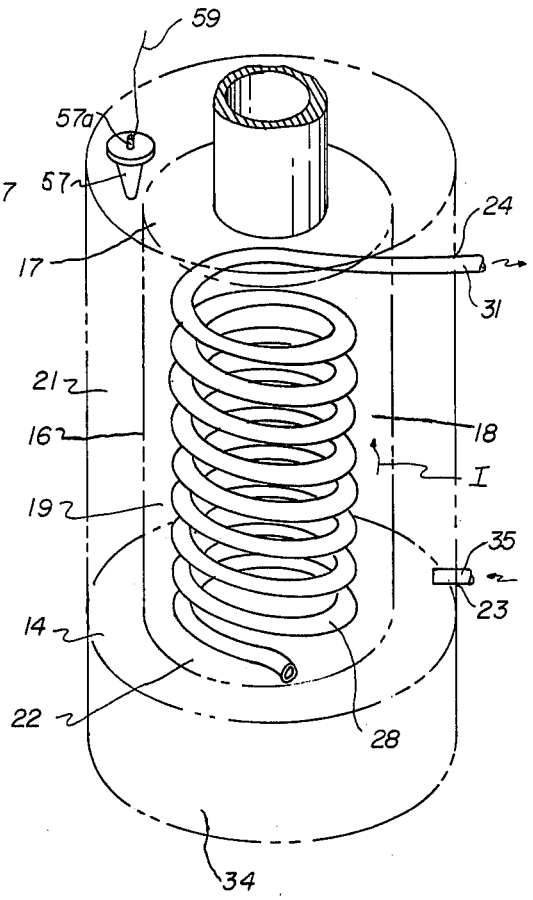
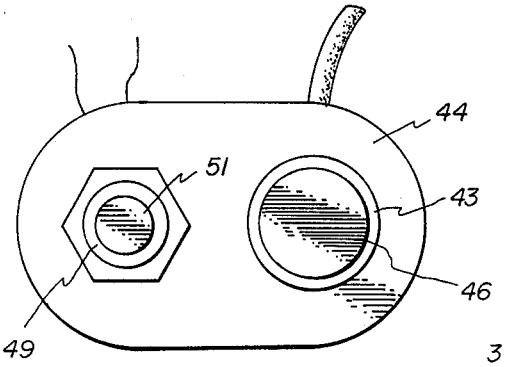
FIG. 3
FIG. 4
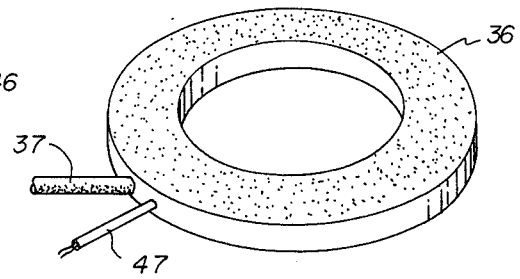

ENGINE BLOCK HEATER

BACKGROUND OF THE INVENTION

A problem that has confronted the operators of motor vehicles such as trucks and stationary equipment or the like having internal combustion engines and in particular diesel engines is the problem of cold weather starting. It is well known that in very cold or sub-zero weather, engine oil tends to solidify and batteries are very inefficient. Thus, the starting of engines in low temperature weather is not only a prolonged operation but also causes excessive wear on batteries, starting motors and the like. Furthermore, as the engine oil is quite viscous at low temperature, proper circulation of the oil is not obtained during engine starting so that inadequate lubrication of the engine during starting results causing wear and tear on the engine parts. It is well known that equipment operators who must periodically stop for rest and sustenance attempt to avoid the problems of cold starting their diesel engines in their equipment by leaving the engine running during such periods which may last from some minutes to many hours, especially if such running is overnight. Consequently, considerable fuel is consumed during such idling operation of the engine not only adding considerably to the cost of operating the equipment but also producing pollutants which can be both annoying and destructive. Some attempt has been made to alleviate the problem of cold starting by the use of heaters inserted into the engine block such as immersion-type electric water heaters. However, such heaters require an electric outlet for each engine at any one given location and electric heaters are useless during power failures, or in rural areas where electric power is rare or non-existent.

OBJECTS AND SUMMARY OF THE INVENTION

Accordingly, a primary object of this invention is to provide a new and novel heater for the engine block of internal combustion engines such as diesel engines for improved cold weather starting of such engines.

Another object of this invention is to provide a new and novel heater for the coolant in liquid cooled internal combustion engines which does not require an electric power source and which is extremely simple and inexpensive in construction.

A further object of this invention is to provide a new and novel heater for an internal combustion engine which requires a minimum of fuel for maintaining engine block temperature which facilitates cold weather starting of the engine and which permits a substantial saving of engine fuel with the concommitant elimination of pollution.

Still another object of this invention is to provide a new and novel heater for the block in a liquid cooled internal combustion engine which may be easily installed in a vehicle such as a truck and a minimum of effort, which is extremely inexpensive to operate and which may be easily adjusted to provide the desired degree of heating of the engine block coolant over a wide range.

The invention will be better understood as well as further objects and advantages become apparent from the ensuing detailed description of the preferred embodiment taken in conjunction with the drawing.

BRIEF DESCRIPTION OF THE DRAWING

FIG. 1 is a perspective view of the heater of the invention;

FIG. 2 is a view similar to FIG. 1 illustrating the interior construction of the heater;

FIG. 3 is a front view of a control unit utilized with the heater of FIG. 1; and FIG. 4 is a perspective view of the gas burner utilized in the heater of FIG. 1.

DESCRIPTION OF THE PREFERRED EMBODIMENT

Referring now to the drawing and to FIG. 1 in particular there is shown a heater for heating and circulating the coolant in an engine block of a internal combustion engine (not shown) which is designated generally by the letter H. The heater H includes an outer casing 11 preferably, but not limited to, a circular cross-sectional shape having a top wall 12, a side wall 13 and a bottom wall 14. An inner casing 16 also preferably, but not limited to, a circular cross-sectional shape is disposed within the interior of the outer casing 11 and is provided with a top wall 17 and a side wall 18 defining an interior 19. The outer and inner casings 11, 16 are arranged in, but not limited to, a concentric relationship to define an annular chamber 21. The bottom end of the inner casing 16 is open to provide an opening 22.

The outer casing 11 is provided with inlet and outlet openings 23, 24 communicating by means such as hoses 26, 27 with the bottom and top respectively of the engine block (not shown) so that the coolant or water in the engine block is circulated through the annular chamber 21 between the inner and outer casings 16-11.

A fluid conduit 28 preferably, but not limited to, a helical configuration is disposed within the interior 19 of the inner casing 16 and extends vertically between the top wall 17 and the bottom opening 22 as shown best in FIG. 2. The opposite ends 31, 32 of the fluid conduit or coil 28 are arranged adjacent to the inner casing top wall 17 and the opening 22 respectively. The upper end 31 of the fluid conduit 28 extend through the inner casing side wall 18, the annular chamber 21 and the side wall 13 of the outer casing 11 to form an outlet which is connected to hose 27. The lower end 32 of the coil 28 extends through the side wall 18 of the inner casing 16 in communication with the annular chamber 21 which communicates with hose 26 through an inlet duct 35 disposed within the opening 23 in the outer casing side wall 13. Thus, the interior 18 of the inner casing 16 provides a fire chamber throughout which the fluid conduit or coil 28 extends. The inlet duct 35 is connected to hose 26 through a check valve 40 which allows fluid into annular chamber 21 but prevents reverse flow, inlet duct 35 being preferably slightly larger in diameter than the diameter of the upper end 31 of coil 28.

Heating means are provided in the heater H for introducing hot gases within the interior 19 of the inner casing 16. Most specifically, the outer casing 11 is extended downwardly to form a base enclosure 33 having an interior 34 in which is suitably mounted a gas burner 36 of, but not limited to annular configuration as shown best in FIG. 4. Preferably, the gas burner 36 is of the type for burning liquified propane gas which is supplied to the burner 36 from a source of liquified propane (not shown) through a pipe 37. The enclosure 33 may be provided with a viewing plate 39 mounted therein.

The pipe 37, which is connected to the source of liquified propane gas, is preferably provided with a manually operated valve designated generally by the numeral 43 which is provided on a panel or console 44 suitably mounted within a location such as, but not limited to, the cab of the vehicle on which the heater H is installed for operation by the equipment operator. The valve 43 includes operating knob 46 and is arranged to be moved from a closed position to a plurality of settings for varying the amount of propane introduced into the burner 36.

The burner 36 is also provided with ignition means designated generally in FIG. 4 by the numeral 47. The ignition means 47 is preferably a self-contained magneto type igniter 51 which is grounded to the burner 36. The igniter 51 does not require the use of a battery or any external power source as it creates a spark when activated. Control of the ignition means 47 is accomplished by means of a switch 49 also preferably positioned on the console 44 as shown in FIG. 3.

As can be understood, water in the engine block is circulated through the annular chamber 21 and the coil 28 through the hoses 26, 27 and if faster circulation of the water is desired, an electrically operated pump 54 may be provided between the coil end 31 in outlet 24 and hose 27 as shown in FIG. 1. The pump 54 is preferably connected on one side by means of conductor 56 to the positive side of the vehicle battery (not shown) and on the other side to the center post 57*a* of thermostat 57 through conductor 59 so as to be responsive to the temperature of the water in the annular chamber 21. The thermostat 57 is mounted on the upper end wall 12 of the outer casing 11 and is grounded thereto. Thus, the actuation of the pump 54 is controlled by the thermostat 57 so that the temperature of the coolant or water circulating in the system which includes the heater H is maintained at the desired level. The pump 54 is preferably provided with a by-pass pipe 60 to permit unrestricted return of fluid to the engine block when the pump 54 is not in use.

In the operation of the invention, the gas burner 36 is ignited with the igniter 51 so as to burn liquified propane and the hot gases from the burner 36 travel upwardly in the direction of the arrow I within the interior 19 of the inner casing 16 to heat the water in the coil 28. The hot gases are preferably vented from the heater H by means of a duct 61. The water is heated in the coil 28 so that hot water rises in the coil 28. As the hot fluid rises, it creates a circulation from the bottom of the coil to the top and from the bottom of the engine block to the top so as to circulate continuously throughout the system as long as the gas burner 36 is operating. The bottom wall 14 of the outer casing 11 is preferably in the form of an annular flange extending between the inner casing 16 and the outer casing 11 thereby providing a completely sealed annular chamber 21. It should be understood that the gas burner 36 can be provided with a source of LP gas in the form of a small throw-away type bottle or with the larger refillable type of bottle and that the heater H is recommended for placement on the opposite side of the engine block form the fuel intake and as far as possible to the rear of the engine block for safety purposes.

It should also be understood, that the circulation of hot water in the engine block will normally provide instant starting. The gas valve 43 will normally have three settings to provide the proper degree of heat depending on outside temperature. For example, if the outside temperature is approximately 20 degrees below zero, the setting would be at an intermediate point in order to keep the water at a higher temperature without activating the pump 54. In extremely cold weather, such as in the Arctic or the like, the equipment operator would set the gas valve 43 to the highest point in order to bring the water temperature up faster. It should further be understood that any suitable coolant may be used with the heater H of the invention instead of water. The normal operating temperature for diesel engines ranges between 160° to 180° but it should be understood the heater H is not limited to diesel engines but they may also be used on gasoline engines when the proper safety measures have been taken.

What is claimed is:

1. A heater for the coolant in a liquid-cooled internal combustion engine having a block comprising, in combination, an outer casing having a top wall, a bottom wall and a side wall, an inner casing having a top wall, and a side wall defining an interior disposed within said outer casing and provided with an open bottom end, said inner and outer casing defining an annular chamber therebetween, a fluid inlet and a fluid outlet in said outer casing side wall, means connected to said fluid inlet for communicating said annular chamber with the coolant in said engine block, a fluid conduit disposed within said inner casing interior, said fluid conduit having oppositely disposed ends, one of said fluid conduit ends communicating through said inner casing side wall with said annular chamber and the other of said fluid conduit ends communicating directly through said fluid outlet with the coolant in said engine block, whereby cooling fluid fills said block, said annular chamber and said fluid conduit, heating means disposed adjacent said inner casing open bottom end and means for controlling said heating means for heating the fluid within said fluid conduit whereby heated fluid is circulated from said annular chamber throughout said fluid conduit, to said block and back to said annular chamber.

2. A heater in accordance with claim 1 wherein said means for communicating said fluid with the engine block includes an electrically operated pump on said outlet and means for connecting said pump to an associated source of electric power wherein said means for connecting said pump to an associated source of electric power include a thermostat responsive to the temperature of the fluid in said annular chamber.

3. A heater in accordance with claim 2 wherein said fluid conduit has a helical configuration extending vertically within said inner casing interior and wherein said oppositely disposed ends of said fluid conduit are positioned adjacent said top wall and bottom end respectively of said inner casing.

4. A heater in accordance with claim 3 wherein said outer casing bottom wall comprises an annular flange extending between said inner and outer casings.

5. A heater in accordance with claim 4 wherein said inner and outer casings are of circular cross-sectional shape.

6. A heater in accordance with claim 3 wherein said heating means comprises a liquified propane gas burner, and means for communicating an associated source of liquified propane gas with said burner and including a duct in said inner casing top wall extending through said outer casing top wall for venting the combustion products of said gas burner from the interior of said inner casing.

7. A heater in accordance with claim 6 wherein said means for communicating said associated source of liquid propane gas with said burner including a valve and wherein said means for controlling said heating means include manually operated means for actuating said valve to move said valve between a closed position and a selected open position for varying the flow of propane gas from said associated source to said burner.

8. A heater in accordance with claim 7 wherein said means for controlling said heating means include ignition means operatively associated with said gas burner and manually operated means for actuating said ignition means to ignite the gas flowing in said gas burner.

9. A heater in accordance with claim 8 including a tubular extension on the lower end of said outer casing defining an enclosure and wherein said heating means is disposed within said enclosure, said enclosure including a sight glass.

10. The device of claim 6 including a check valve on said fluid inlet to prevent reversal of the coolant flow from said annular chamber through said fluid inlet.

* * * * *